US010253661B2

(12) United States Patent
Miyajima et al.

(10) Patent No.: US 10,253,661 B2
(45) Date of Patent: Apr. 9, 2019

(54) RELIEF DEVICE FOR OIL PUMP

(71) Applicant: YAMADA MANUFACTURING CO., LTD., Kiryu-shi (JP)

(72) Inventors: Junichi Miyajima, Kiryu (JP); Hidehiko Koyashiki, Kiryu (JP); Takatoshi Watanabe, Kiryu (JP)

(73) Assignee: YAMADA MANUFACTURING CO., LTD., Kiryu-Shi, Gunma (JP)

( * ) Notice: Subject to any disclaimer, the term of this patent is extended or adjusted under 35 U.S.C. 154(b) by 760 days.

(21) Appl. No.: 14/567,943

(22) Filed: Dec. 11, 2014

(65) Prior Publication Data

US 2015/0167514 A1 Jun. 18, 2015

(30) Foreign Application Priority Data

Dec. 18, 2013 (JP) ..... 2013-261770

(51) Int. Cl.

| | |
|---|---|
| ***F01M 5/00*** | (2006.01) |
| ***F04B 49/24*** | (2006.01) |
| ***F01M 1/16*** | (2006.01) |
| ***F04C 2/10*** | (2006.01) |
| ***F04C 14/26*** | (2006.01) |

(52) U.S. Cl.

CPC ..... *F01M 5/007* (2013.01); *F01M 1/16* (2013.01); *F04C 2/102* (2013.01); *F04C 14/26* (2013.01)

(58) Field of Classification Search

CPC ..... F04C 2/102; F04C 14/26; F04C 14/24; F01M 1/16; F01M 5/007; F01M 1/08

USPC ..... 417/292; 137/487

See application file for complete search history.

(56) References Cited

U.S. PATENT DOCUMENTS

| | | | | |
|---|---|---|---|---|
| 2,353,306 | A * | 7/1944 | Henry | F16K 17/06 137/542 |
| 4,540,153 | A * | 9/1985 | Gomi | F02P 5/103 123/568.31 |
| 5,794,652 | A * | 8/1998 | Mukumoto | F16K 17/105 137/474 |
| 7,819,093 | B2 * | 10/2010 | Yamashita | F01M 1/08 123/196 R |
| 2012/0241022 | A1 * | 9/2012 | Watanabe | F01M 1/16 137/487 |

FOREIGN PATENT DOCUMENTS

JP 2006-214286 A 8/2006

* cited by examiner

*Primary Examiner* — Dominick L Plakkoottam
*Assistant Examiner* — Connor J Tremarche
(74) *Attorney, Agent, or Firm* — McGinn I. P. Law Group, PLLC.

(57) ABSTRACT

A relief device for an oil pump includes a relief valve including a small diameter valve chamber and a large diameter valve chamber and a valve housing that includes a relief discharge section, a temperature sensitive valve, an oil pump, a main channel, a relief channel, and an auxiliary channel. The relief channel causes one side of the small diameter valve chamber and the large diameter valve chamber and the oil pump to always communicate with each other and enables oil to be discharged from the relief discharge section. The auxiliary channel enables the other one side of the small diameter valve chamber and the large diameter valve chamber and the oil pump to communicate with each other. The temperature sensitive valve is included in the auxiliary channel.

4 Claims, 8 Drawing Sheets

RELIEF DEVICE FOR OIL PUMP

BACKGROUND OF THE INVENTION

1. Field of the Invention

The present invention relates to a relief valve for an oil pump that is particularly suitable for an internal combustion engine for power generation of an electric automobile, includes a relief valve and a temperature sensitive valve, enables execution of a relief (oil discharge) operation in a pressure rise irrespective of the level of the temperature of oil, and can be simplified in a configuration thereof.

2. Description of the Related Art

In recent years, electric automobiles are increasing. The electric automobiles have various types of power generation systems. Among the power generation systems, a range extender is suitable for the electric automobiles. In the range extender, an internal combustion engine and a generator are mounted on an automobile. The engine performs charging of the generator. The generator drives a drive motor to enable the automobile to travel.

As an oil pump for supplying oil to an engine to lubricate the engine, there are various oil pumps including a relief valve that performs relief when a discharge pressure exceeds a predetermined value. Further, there are a large number of relieve devices for oil pumps of a type for determining whether relief is executed according to a pressure change and a temperature change of oil.

Japanese Patent Application Laid-open No. 2006-214286 discloses a representative example of the relief valves of this type. An embodiment (a third embodiment) including a second control valve 7 among a plurality of embodiments disclosed in Japanese Patent Application Laid-open No. 2006-214286 is summarized. Note that signs used in Japanese Patent Application Laid-open No. 2006-214286 are used as they are. In an oil pump X, hydraulic oil from a pump main body 1 is discharged only from a single discharge port 31. A first control valve 4 functions only as a relief valve when a discharge pressure of the hydraulic oil in a discharge oil passage 5 is high. The second control valve 7 is a valve that operates according to the temperature of the hydraulic oil to control the first control valve 4 and, specifically, controls the hydraulic pressure of the hydraulic oil flowing into a second valve chamber 44 of the first control valve 4.

In the oil pump X, the second control valve 7 is maintained in a normal state when the temperature of the hydraulic oil is in a normal temperature range lower than about 110° C. The first control valve 4 operates according to a discharge pressure of the hydraulic oil discharged to the discharge oil passage 5. When the discharge pressure of the hydraulic oil rises, the first control valve 4 causes a first valve chamber 43 and a return port 41d to communicate with each other and supplies a part of the hydraulic oil in the discharge oil passage 5 to a return oil passage 6 to thereby perform relief of the discharge pressure.

When the temperature of the hydraulic oil is high, the first control valve 4 performs control without operating as the relief valve. Therefore, it is possible to design the oil pump X to have an optimum characteristic of the discharge pressure in the normal temperature range lower than about 110° C., which is a temperature range of the hydraulic oil under a normal condition of use, while securing a necessary discharge pressure of the hydraulic oil when oil is at a high temperature.

A relief valve device that performs a complicated operation disclosed in Japanese Patent Application Laid-open No. 2006-214286 is suitable for an oil pump for an engine in an automobile including only an internal combustion engine. However, in the electric automobile explained above, the engine plays the roles for power generation and charging of the generator. Therefore, the speed of the engine is substantially fixed. An intermediate engine speed region only has to be maintained.

As explained above, in the electric automobile, compared with the engine used for only power generation, the relief device disclosed in Japanese Patent Application Laid-open No. 2006-214286 has a drawback in that a hydraulic pressure reduction effect is small and only costs increase. In particular, since relief is not performed when the temperature of the hydraulic oil is high, it is likely that energy is wastefully consumed.

SUMMARY OF THE INVENTION

Therefore, it is an object of the present invention (a technical task of the invention) to provide a relief device for an oil pump that has an extremely simple configuration, performs a relief operation in a relief required state irrespective of the level of oil temperature, and is inexpensive and has high reliability.

Therefore, in order to solve the problem, the inventor earnestly carried out researches in order to solve the problems and solved the problems according to embodiments of the present invention explained below.

According to a first embodiment of the present invention, there is provided a relief device for an oil pump including: a relief valve including a valve body that includes a small diameter section and a large diameter section, and a valve housing that includes a small diameter valve chamber and a large diameter valve chamber and a relief discharge section provided on one side of the small diameter valve chamber and the large diameter valve chamber; a temperature sensitive valve; an oil pump; a main channel provided downstream of the oil pump; and a relief channel and an auxiliary channel branching from the main channel. The relief channel causes one side of the small diameter valve chamber and the large diameter valve chamber and the oil pump to always communicate with each other and enables oil to be discharged from the relief discharge section. The auxiliary channel enables the other one side of the small diameter valve chamber and the large diameter valve chamber and the oil pump to communicate with each other. The temperature sensitive valve is included in the auxiliary channel. The temperature sensitive valve controls the auxiliary channel to be in a communication state when oil is at a low temperature and controls the auxiliary channel to be in a non-communication state when oil is at a high temperature.

According to a second embodiment of the present invention, in the relief valve for the oil pump according to the first embodiment, the relief discharge section is provided in the small diameter valve chamber. The relief channel causes the small diameter valve chamber and the oil pump to always communicate with each other. The auxiliary channel enables the large diameter valve chamber and the oil pump to communicate with each other.

According to a third embodiment of the present invention, in the relief valve for the oil pump according to the first embodiment, the relief discharge section is provided in the large diameter valve chamber. The relief channel causes the large diameter valve chamber and the oil pump to always communicate with each other. The auxiliary channel enables the small diameter valve chamber and the oil pump to communicate with each other.

According to a fourth embodiment of the present invention, in the relief valve for the oil pump according to the first or second embodiment, a projecting section that forms a gap is provided in at least one of an upper end part of the large diameter valve chamber and the top of the large diameter section.

According to a fifth embodiment of the present invention, in the relief valve for the oil pump according to the first or second embodiment, the temperature sensitive valve includes a temperature sensitive valve body and a temperature sensitive housing. The temperature sensitive valve body includes a temperature sensitive valve section and a temperature sensitive driving section including a temperature sensitive sensor. The temperature sensitive valve section is slid in the temperature sensitive housing by the temperature sensitive driving section thereby controlling the auxiliary channel to be in a communication state or in a non-communication state.

According to a sixth embodiment of the present invention, in the relief valve for the oil pump according to the fifth embodiment, a non-electronically controlled component is used in the temperature sensitive sensor.

According to a seventh embodiment of the present invention, in the relief valve for the oil pump according to the sixth embodiment, thermo-wax is used as the temperature sensitive sensor.

In the present invention, the relief channel causes one side of the small diameter valve chamber and the large diameter valve chamber and the oil pump to always communicate with each other and enables oil discharge from the relief discharge section. The auxiliary channel causes the other one side of the small diameter valve chamber and the large diameter valve chamber and the oil pump to communicate with each other. The temperature sensitive valve is provided in the auxiliary channel. The temperature sensitive valve controls the auxiliary channel to the communication state when oil is at a low temperature and controls the auxiliary channel to the non-communication state when oil is at a high temperature.

Therefore, the auxiliary channel is controlled to the communication state when oil is at a low temperature by the temperature sensitive valve. Pressure from the relief channel is applied to one side of the small diameter section and the large diameter section of the valve body. Auxiliary pressure from the auxiliary channel is applied to the remaining other side of the small diameter section and the large diameter section. Therefore, at an early stage immediately after an engine start, the valve body starts movement, the relief discharge section opens, and relief of the oil can be started. Therefore, even if the engine is in a high engine speed region in a state of low oil temperature immediately after the engine start, it is possible to keep pressure during high engine speed appropriate by performing a relief operation at low pressure.

As explained above, when oil is at a low temperature, even when viscosity is high and, therefore, hydraulic pressure is also high, it is possible to reduce pressure, reduce wasteful work performed at hydraulic pressure higher than necessary hydraulic pressure, and improve fuel efficiency. When oil is at a high temperature, the temperature sensitive valve controls the auxiliary channel to be in a non-communication state. The relief valve receives pressure of the oil from only the relief channel. Consequently, it is possible to perform a normal relief operation. In this way, the relief device in the present invention can perform a proper relief operation according to a change in discharge pressure irrespective of the level of oil temperature. In particular, the relief valve is suitably used for an electric automobile.

In an electric automobile mounted with an engine functioning as an internal combustion engine, a drive motor for automobile traveling, and a generator, when a charged capacity of a battery decreases, the drive motor is rotated with electricity obtained by rotating the generator with the engine. With such a configuration, the speed of the engine is substantially fixed. Actually, an intermediate engine speed region is a normal driving state.

Therefore, a discharge pressure from the oil pump is generally affected by the level of oil temperature. As in the present invention, the relief operation is suitably performed irrespective of low temperature and high temperature of the oil. In this way, when the oil temperature is low and the engine is rotated at high speed immediately after the start of the engine, pressure rises in that state. However, it is possible to suppress the pressure from rising according to the present invention.

DESCRIPTION OF THE PREFERRED EMBODIMENTS

Figure 1:
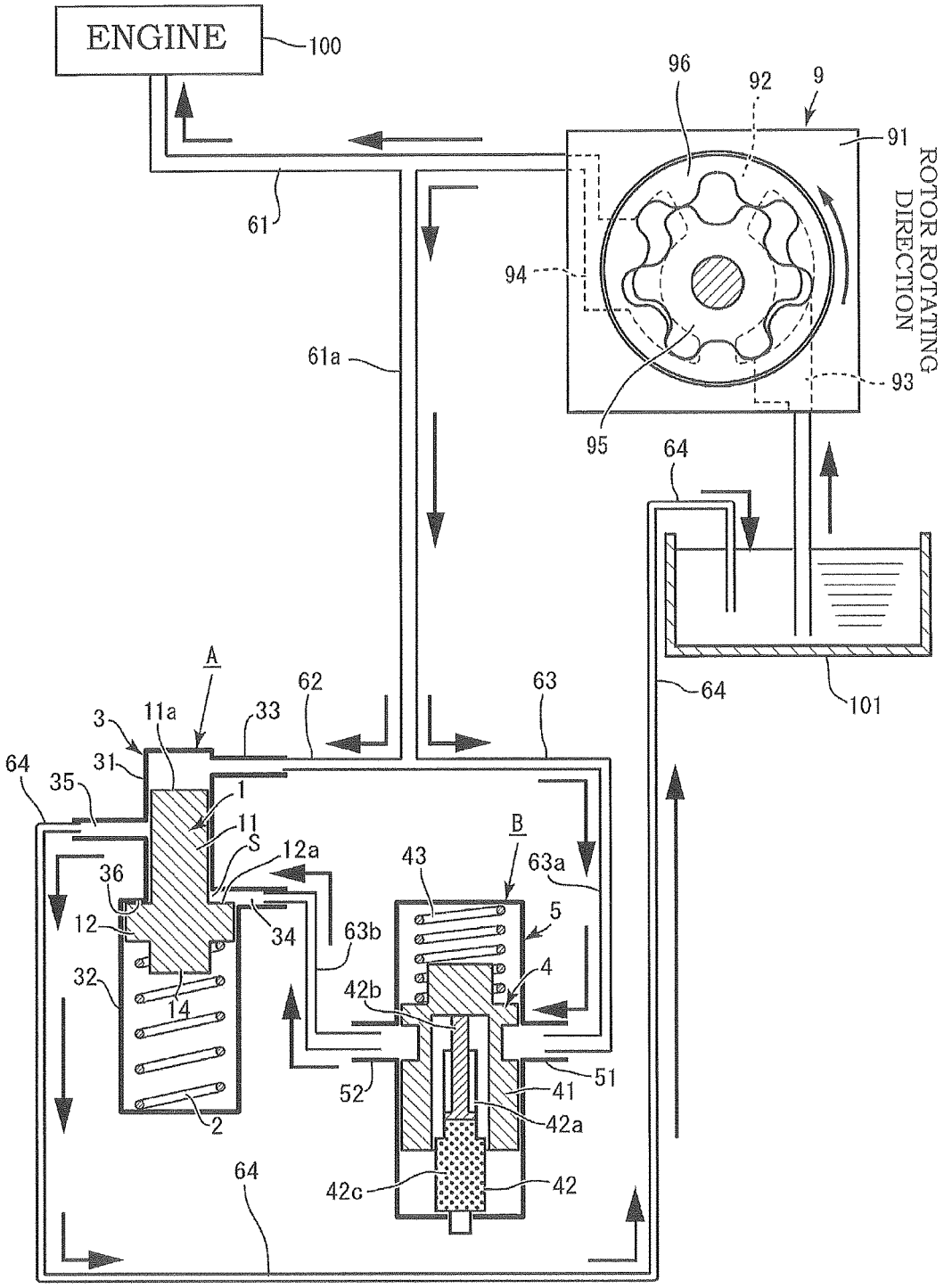
FIG. 1 is a schematic diagram showing an overall configuration in a first embodiment of the present invention.

In the present invention, there are two embodiments. First, a first embodiment is explained with reference to FIGS. to 3B. A configuration in the first embodiment mainly includes a relief valve A, a temperature sensitive valve B, a main channel 61, a relief channel 62, an auxiliary channel 63, and an oil pump 9 (see FIG. 1). The relief valve A includes a valve body 1, an elastic member 2, and a valve housing 3 (see FIG. 1).

The valve body 1 includes a cylindrical small diameter section 11 and a cylindrical large diameter section 12. The small diameter section 11 and the large diameter section 12 are integrally formed with axes thereof matched. The diameter of the small diameter section 11 is formed smaller than the diameter of the large diameter section 12. The small diameter section 11 is formed long in the axial direction to have a substantially columnar shape. The large diameter section 12 is formed in a flat cylindrical shape.

An end face at an axial direction one end of the small diameter section 11 (the upper end face of the valve body 1 in FIG. 1) is a first pressure receiving surface 11*a*. A step surface serving as a boundary between the axial direction other end of the small diameter section 11 and an axial direction one end of the large diameter section 12 is a second pressure receiving surface 12*a*. The second pressure receiving surface 12*a* is a portion obtained by removing the cross sectional area of the small diameter section 11 from the top of the large diameter section 12 and is a substantially annular surface.

At the axial direction other end of the large diameter section 12 (the lower end face of the valve body 1 in FIG. 1), a cylindrical protrusion section 14 is formed. The protrusion section 14 plays a role of supporting an elastic member 2 such as a coil spring. The protrusion section 14 is structured to be inserted into the elastic member 2 such as the coil spring.

The valve housing 3 includes a small diameter valve chamber 31 and a large diameter valve chamber 32. The small diameter valve chamber 31 is a valve chamber in which the small diameter section 11 of the valve body 1 slides. The large diameter valve chamber 32 is a valve chamber in which the large diameter section 12 slides. Note that, in the small diameter valve chamber 31, only the small diameter section 11 slides. However, the small diameter section 11 enters the large diameter valve chamber 32 together with the large diameter section 12. A first inlet section 33 is formed in the small diameter valve chamber 31 of the valve housing 3. Specifically, as shown in FIG. 1, the first inlet section 33 is formed near the upper end part of the small diameter valve chamber 31.

A second inlet section 34 is formed near the boundary between the small diameter valve chamber 31 and the large diameter valve chamber 32. Specifically, the second inlet section 34 is formed in the top part of the large diameter valve chamber 32. A part of the second inlet section 34 is sometimes structured to cross the small diameter valve chamber 31. The relief channel 62 explained below is connected to the first inlet section 33. Oil is caused to flow into the small diameter valve chamber 31 from the first inlet section 33. The pressure of the oil is applied to the first pressure receiving surface 11*a* of the small diameter section 11 to move the valve body 1 in a direction from the small diameter valve chamber 31 to the large diameter valve chamber 32. In a state in which the large diameter section 12 of the valve body 1 does not receive the pressure of the oil, a state in which the top of the large diameter section 12, that is, the second pressure receiving surface 12*a* and the top of the large diameter valve chamber 32 are brought closest to each other by the elastic member 2 is set as an initial position of the valve body 1.

The auxiliary channel 63 is connected to the second inlet section 34. The oil flown into the large diameter valve chamber 32 from the second inlet section 34 applies the pressure of the oil to the second pressure receiving surface 12*a* of the large diameter section 12. A relief discharge section 35 is formed in the small diameter valve chamber 31. The relief discharge section 35 is opened and closed by a reciprocating slide of the small diameter section 11 of the valve body 1. When opened, the relief discharge section 35 plays a role of discharging the oil from the relief valve A to the outside and returning the oil to the oil pump 9 or an oil pan 101. The relief discharge section 35 is located between the first inlet section 33 and the second inlet section 34. In the initial position, the relief discharge section 35 is closed by the small diameter section 11.

In the relief valve A, a projecting section 13 or a projecting section 36 for forming a gap is provided on any one side or both of the upper end part of the large diameter valve chamber 32 and the top of the large diameter section 12. That is, in the initial position state of the valve body 1, when the oil is caused to flow into the large diameter valve chamber 32 from the auxiliary channel 63 via the second inlet section 34, the projecting section 13 or the projecting section 36 plays a role of securing an environment in which the flown-in oil easily press the second pressure receiving surface 12*a* instantaneously and uniformly.

When the valve body 1 moves from the large diameter valve chamber 32 side to the small diameter valve chamber 31 side to the maximum, that is, at the time of the initial position state of the valve body 1, in other words, a state in which the large diameter section 12 reaches the upper end position of the large diameter valve chamber 32 in FIG. 1, a gap S is formed between the upper end of the large diameter valve chamber 32 and the second pressure receiving surface 12*a* of the large diameter section 12 by the projecting section 13 or the projecting section 36.

The gap S makes it easy for the oil to flow into the large diameter valve chamber 32 from the auxiliary channel 63 via the second inlet section 34. In the initial position state of the valve body 1, it is possible to instantaneously and efficiently apply pressure to the second pressure receiving surface 12*a*. The projecting section 13 is formed on the valve body 1 side and is formed in a circumferential shape in the boundary part between the second pressure receiving surface 12*a* of the large diameter section 12 and the small diameter section 11.

Specifically, the projecting section 13 formed on the valve body 1 side is formed in a substantially annular shape along the outer circumference of the small diameter section 11 on the second pressure receiving surface 12*a*. In the projecting section 36 formed on the large diameter valve chamber 32 side, an annular part having an inner diameter same as the inner diameter of the small diameter valve chamber 31 is formed at the top of the large diameter valve chamber 32.

With the projecting section 13 and the projecting section 36, even if the large diameter section 12 of the valve body 1 reaches the top of the large diameter valve chamber 32, the second pressure receiving surface 12*a* does not entirely come into contact with the top of the large diameter valve chamber 32. The gap S can be formed on the second pressure receiving surface 12*a*. The substantially entire second pressure receiving surface 12*a* can receive the pressure of the oil flown in from the second inlet section 34.

The temperature sensitive valve B includes a temperature sensitive valve body 4 and a temperature sensitive housing 5. The temperature sensitive valve body 4 includes a temperature sensitive valve section 41 and a temperature sensitive driving section 42. The temperature sensitive driving section 42 detects the temperature of oil and slides the temperature sensitive valve section 41 in the temperature sensitive housing 5. In the temperature sensitive housing 5, a first auxiliary port section 51 and a second auxiliary port section 52 are formed.

The temperature sensitive driving section 42 also has a role of a temperature sensitive sensor. Specifically, the temperature sensitive driving section 42 is a member of a cylinder type and includes a cylinder 42*a* and a piston 42*b*. A temperature sensitive sensor 42*c* is provided in the cylinder 42*a*. Thermo-wax is used as the temperature sensitive sensor 42*c*. Specifically, a portion filled with the thermo-wax is provided in the cylinder 42*a* (see FIG. 1). The thermo-wax performs expansion and thermal contraction according to the level of temperature detected by the thermo-wax. The piston 42*b* performs expansion and contraction actions with respect to the cylinder 42*a*.

Consequently, the temperature sensitive valve section 41 reciprocatingly moves in the temperature sensitive housing 5. The first auxiliary port section 51 and the second auxiliary port section 52 simultaneously open and close according to the slide of the temperature sensitive valve section 41 (see FIG. 1). In the temperature sensitive driving section 42, the thermo-wax is used as the temperature sensitive sensor 42*c*. However, the temperature sensitive driving section 42 is not limited to this. For example, a shape memory alloy or bimetal is sometimes used.

The thermo-wax, the shape memory alloy, the bimetal, or the like used in the temperature sensitive driving section 42 does not use an electric system at all. Therefore, in the present invention, the temperature sensitive driving section 42 is referred to as non-electronically controlled component. Since the non-electronically controlled component is used as the temperature sensitive driving section 42 in the temperature sensitive valve B, an electronically controlled component is not used. Therefore, the temperature sensitive driving section 42 is not affected by a deficiency of an electric system and can stably operate. Further, the temperature sensitive valve section 41 includes an auxiliary elastic member 43 such as a coil spring that applies a load in a direction for always setting the first auxiliary port section 51 and the second auxiliary port section 52 in a communication state and in the opposite direction of the load of the temperature sensitive driving section 42.

The oil pump 9 is an inscribed gear pump. A suction port 93 and a discharge port 94 are formed in a rotor chamber 92 in a pump housing 91 of the oil pump 9. In the rotor chamber 92, an inner rotor 95 and an outer rotor 96 are disposed. External teeth are formed in the inner rotor 95. Internal teeth are formed in the outer rotor 96. The inner rotor 95 is disposed in the outer rotor 96. The inner rotor 95 is driven to rotate together with the outer rotor 96 and discharges, from the discharge port 94, the oil sucked from the suction port 93.

The configuration of an oil circuit including the relief valve A, the temperature sensitive valve B, and the oil pump 9 in the first embodiment of the present invention is explained. The discharge port 94 of the oil pump 9 and an engine 100 communicate with each other through the main channel 61. The relief channel 62 branching from a branch channel 61*a* of the main channel 61 communicates with the first inlet section 33 of the small diameter valve chamber 31 of the relief valve A.

In the oil circuit, the auxiliary channel 63 branching from the branch channel 61*a* of the main channel 61 is provided. The auxiliary channel 63 includes a first auxiliary channel 63*a* and a second auxiliary channel 63*b*. The temperature sensitive valve B is provided in an intermediate part of the auxiliary channel 63. Specifically, the first auxiliary channel 63*a* and the second auxiliary channel 63*b* are controlled to communicate or not to communicate with each other by the temperature sensitive valve B.

The first auxiliary channel 63*a* communicates with the oil pump 9 and the first auxiliary port section 51 of the temperature sensitive valve B. The second auxiliary channel 63*b* communicates with the second auxiliary port section 52 of the temperature sensitive valve B and the second inlet section of the relief valve A. A relief discharge channel 64 is provided between the relief discharge section 35 of the relief valve A and the oil pan 101.

A relief operation in a circulation circuit in the first embodiment of the present invention is explained. In the present invention, as it is evident from the configuration explained above, in the oil circuit, the engine 100, the relief valve A, the temperature sensitive valve B, and the like are disposed on the downstream side of the oil pump 9 (see FIG. 1). In the present invention, the relief valve A performs relief with a stepwise hydraulic pressure in one stage.

First, a basic flow of the oil in the circulation circuit for the oil is explained. The oil discharged from the oil pump 9 is supplied to the engine 100 first via the main channel 61. At the same time, the oil also flows to the relief channel 62 branching from the main channel 61. The oil is fed into the small diameter valve chamber 31 from the first inlet section 33 of the relief valve A. The hydraulic pressure is always applied to the first pressure receiving surface 11*a* of the small diameter section 11 of the valve body 1.

The oil also flows to the first auxiliary channel 63*a* of the auxiliary channel 63 branching from the relief channel 62. The oil reaches the first auxiliary port section 51 of the temperature sensitive valve B. The temperature sensitive valve B detects the level of the temperature of the oil that reaches the first auxiliary port section 51 and controls the first auxiliary channel 63*a* and the second auxiliary channel 63*b* to communicate or not to communicate with each other. When the first auxiliary channel 63*a* and the second auxiliary channel 63*b* are controlled to communicate with each other, the oil reaches the second inlet section 34 of the relief valve A and can apply the hydraulic pressure to the second pressure receiving surface 12*a* of the large diameter section 12.

Figure 2A:
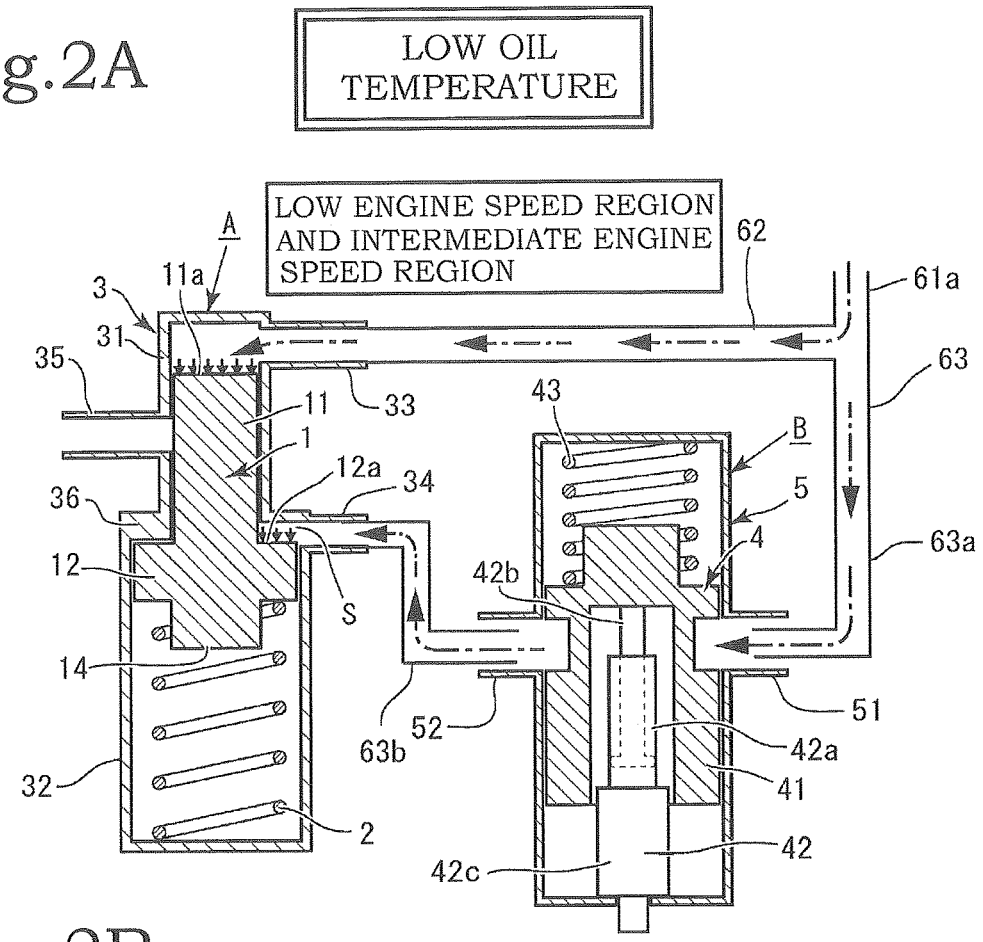
FIG. 2A is an enlarged schematic diagram showing the operations of a relief valve and a temperature sensitive valve at low oil temperature and in a low engine speed region and an intermediate engine speed region of an engine in the first embodiment of the present invention.
Figure 2B:
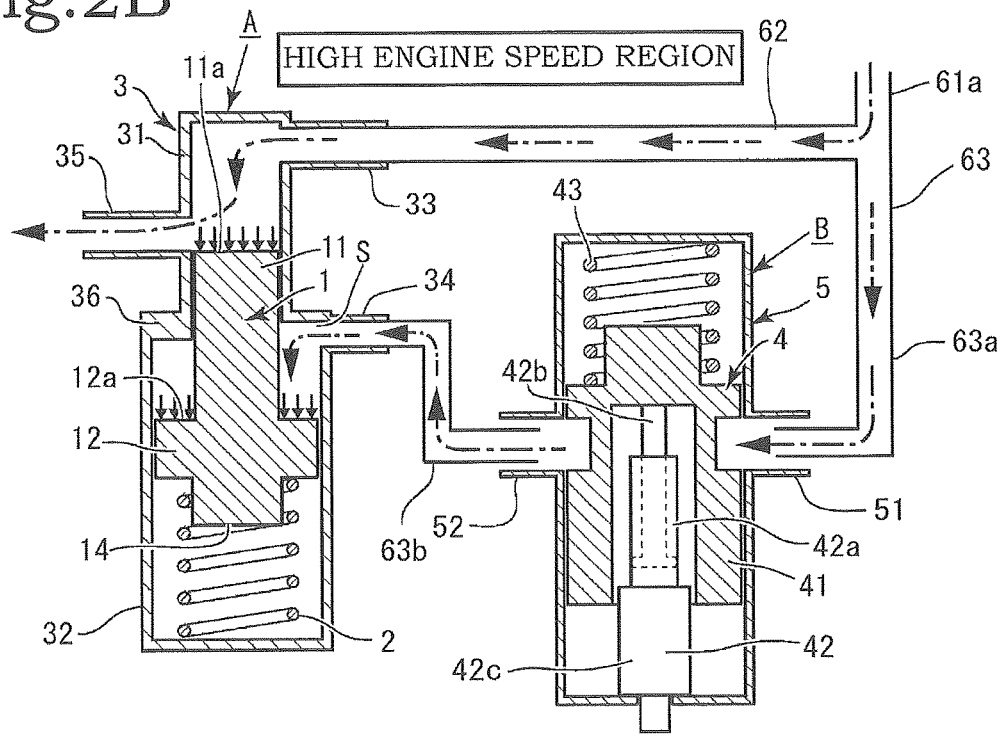
FIG. 2B is an enlarged schematic diagram showing the operations of the relief valve and the temperature sensitive valve at the low oil temperature and in a high engine speed region of the engine.

An operation performed when oil temperature is low is explained with reference to FIGS. 2A and 2B. When the oil temperature is low, the temperature sensitive sensor 42*c* of the temperature sensitive driving section 42 determines that the temperature of the oil is low. The temperature sensitive valve B slides the temperature sensitive valve section 41 to a position where the first auxiliary port section 51 and the second auxiliary port section 52 communicate with each other (see FIG. 2A). The first auxiliary channel 63*a* and the second auxiliary channel 63*b* communicate with each other. The oil flows through both the channels. The oil is fed into the large diameter valve chamber 32 from the second inlet section 34. The oil applies the hydraulic pressure to the second pressure receiving surface 12*a* of the large diameter section 12.

Consequently, the hydraulic pressure is applied to both of the first pressure receiving surface 11*a* and the second pressure receiving surface 12*a* of the valve body 1 by the relief channel 62, the first auxiliary channel 63*a*, and the second auxiliary channel 63*b* branching from the main channel 61. In the row engine speed region and the intermediate engine speed region, even if a force by the pressure of the oil is applied to both of the first pressure receiving surface 11*a* and the second pressure receiving surface 12*a*, since the force is smaller than the elastic force of the elastic member 2, the relief operation is not performed (see FIG. 2A).

In the high engine speed region, the force by the pressure of the oil applied to both of the first pressure receiving surface 11*a* and the second pressure receiving surface 12*a* is larger than the elastic force of the elastic member 2. The valve body 1 slides, the relief discharge section 35 is opened, and relief is performed (see FIG. 2B). In this way, in the case of the low oil temperature, the temperature sensitive valve B controls the auxiliary channel 63 to be in a communication state and feeds the oil to the second pressure receiving surface 12*a* of the large diameter section 12 of the valve body 1. Consequently, the relief operation is easily performed. The relief operation is performed in the high engine speed region. It is possible to reduce wasteful work performed at hydraulic pressure higher than necessary hydraulic pressure. As a result, it is possible to improve fuel efficiency.

Figure 3A:
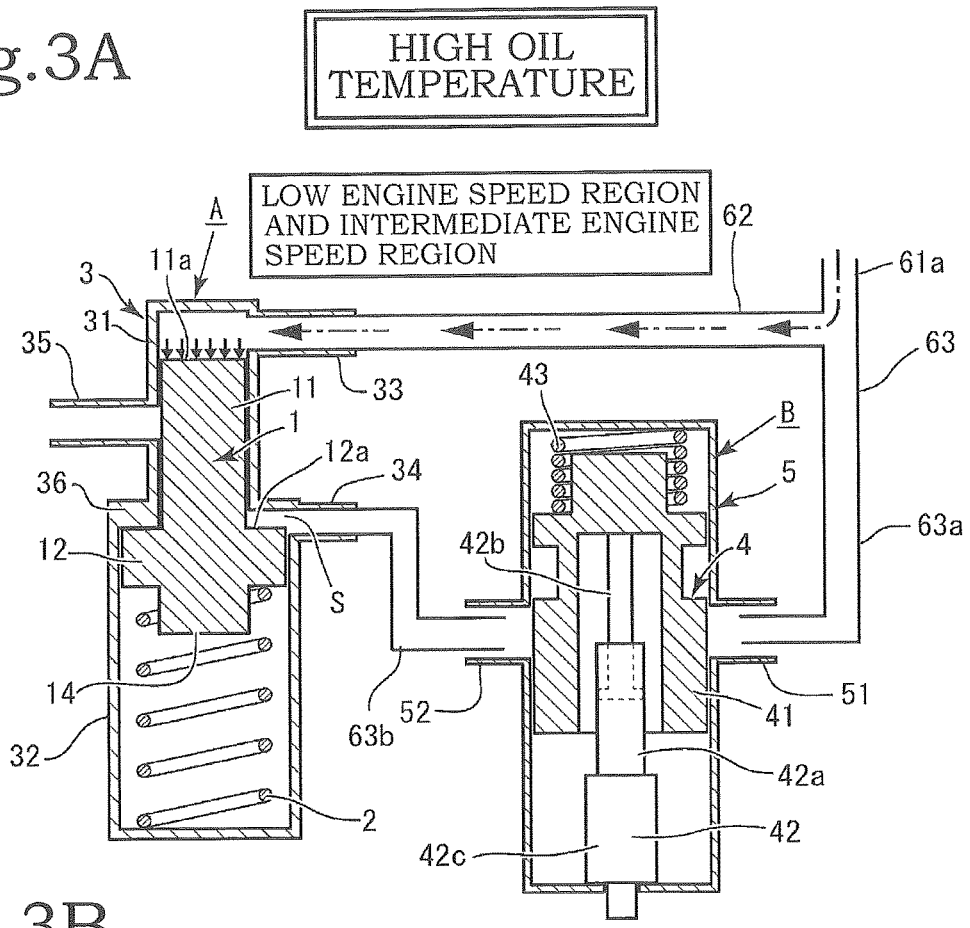
FIG. 3A is an enlarged schematic diagram showing the operations of the relief valve and the temperature sensitive valve at the high oil temperature and in the low engine speed region and the intermediate engine speed region of the engine in the first embodiment of the present invention.

An operation performed when the oil temperature is high is explained with reference to FIGS. 3A and 3B. When the oil temperature is high, the temperature sensitive sensor 42*c* of the temperature sensitive driving section 42 determines that the temperature of the oil is high. The temperature sensitive valve B slides the temperature sensitive valve section 41 to a position where the first auxiliary port section 51 and the second auxiliary port section 52 do not communicate with each other (see FIG. 3A). Consequently, the first auxiliary channel 63*a* and the second auxiliary channel 63*b* do not communicate with each other. The hydraulic pressure is not applied to the second pressure receiving surface 12*a* of the large diameter section 12.

Therefore, the oil flows to only the relief channel 62. Only the first pressure receiving surface 11*a* of the small diameter section 11 of the valve body 1 receives pressure. At the high oil temperature and in the low engine speed region and the intermediate engine speed region, the valve body 1 of the relief valve A does not move, the relief discharge section 35 does not open, and relief is not performed.

Figure 3B:
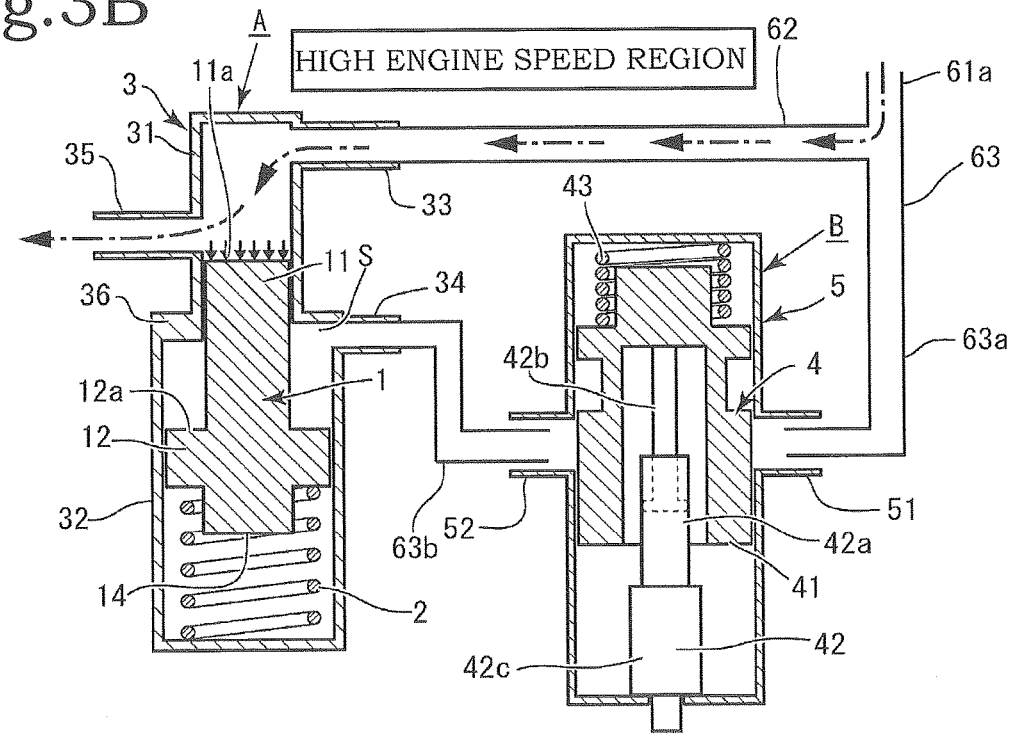
FIG. 3B is an enlarged schematic diagram showing the operations of the relief valve and the temperature sensitive valve at the high oil temperature and in the high engine speed region of the engine.
Figure 4A:
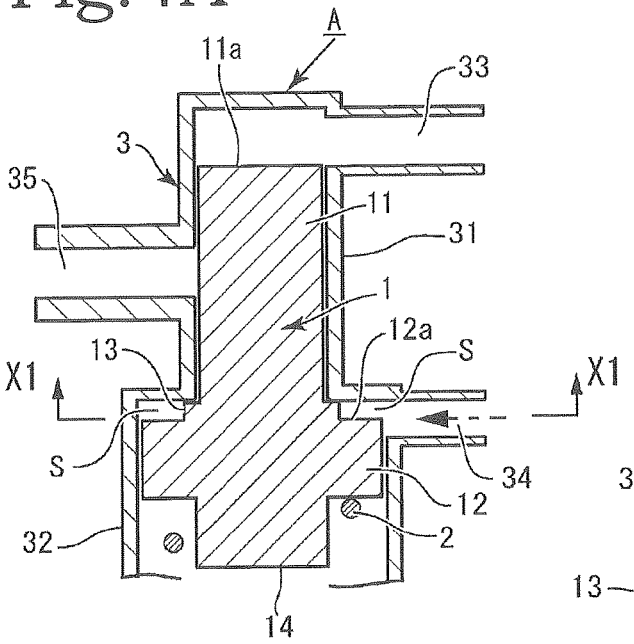
FIG. 4A is a main part enlarged view showing an example of a pressure receiving structure of a second pressure receiving surface in a valve body of the relief valve.
Figure 4B:
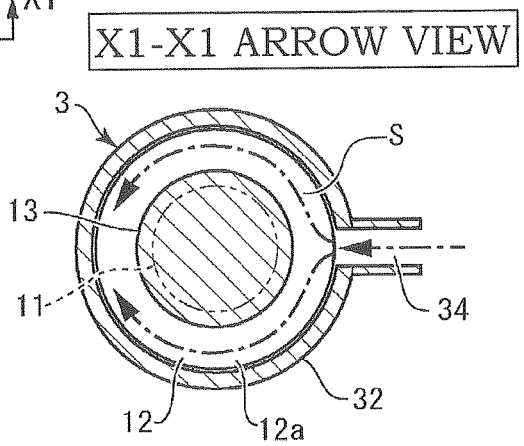
FIG. 4B is an X1-X1 arrow sectional view of FIG. 4A.
Figure 4C:
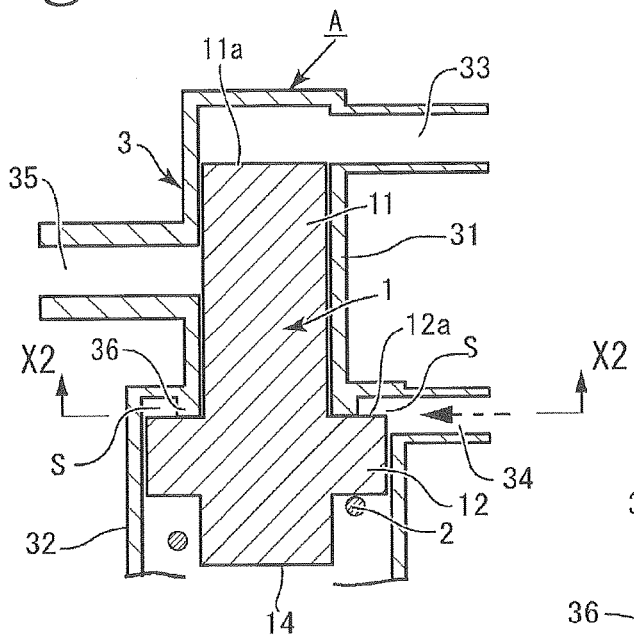
FIG. 4C is a main part enlarged view showing another example of the pressure receiving structure of the second pressure receiving surface in the valve body of the relief valve.
Figure 4D:
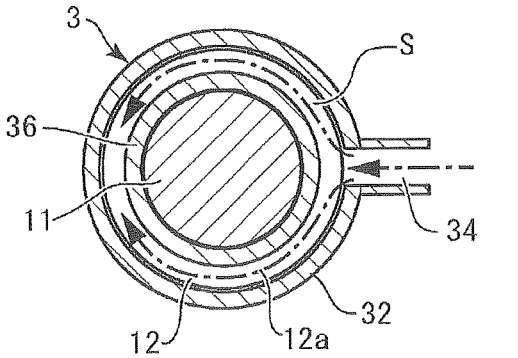
FIG. 4D is an X2-X2 arrow sectional view of FIG. 4C.
Figure 5:
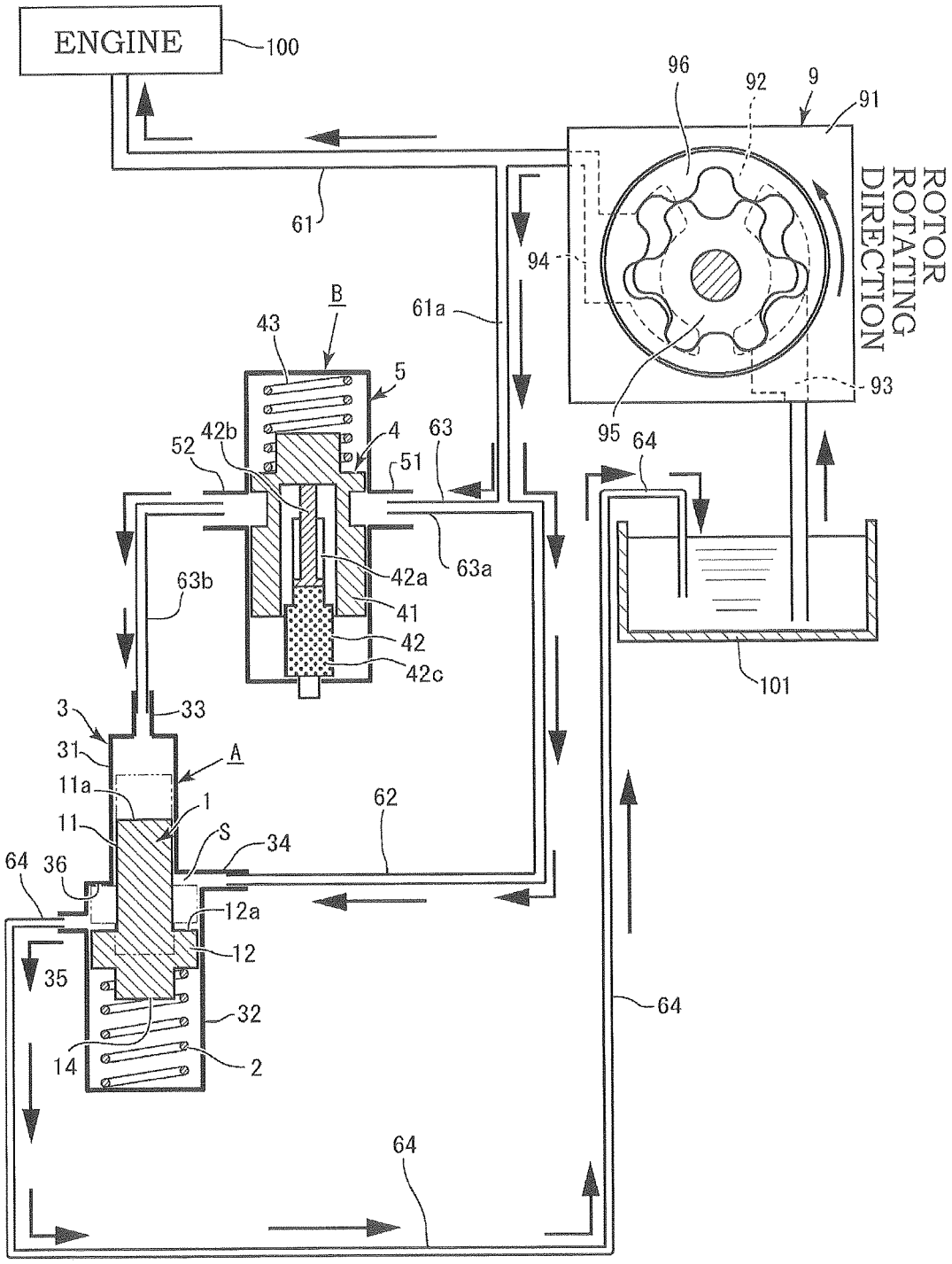
FIG. 5 is a schematic diagram showing an overall configuration in a second embodiment of the present invention.

When the engine speed further increases and reaches the high engine speed region, even if the hydraulic pressure is applied to only the first pressure receiving surface 11*a* of the small diameter section 11 of the valve body 1, according to an increase in the force by the pressure received by the first pressure receiving surface 11*a*, the valve body 1 moves, the relief discharge section 35 opens, and the relief valve A performs a normal relief operation (see FIG. 3B).

Figure 8:
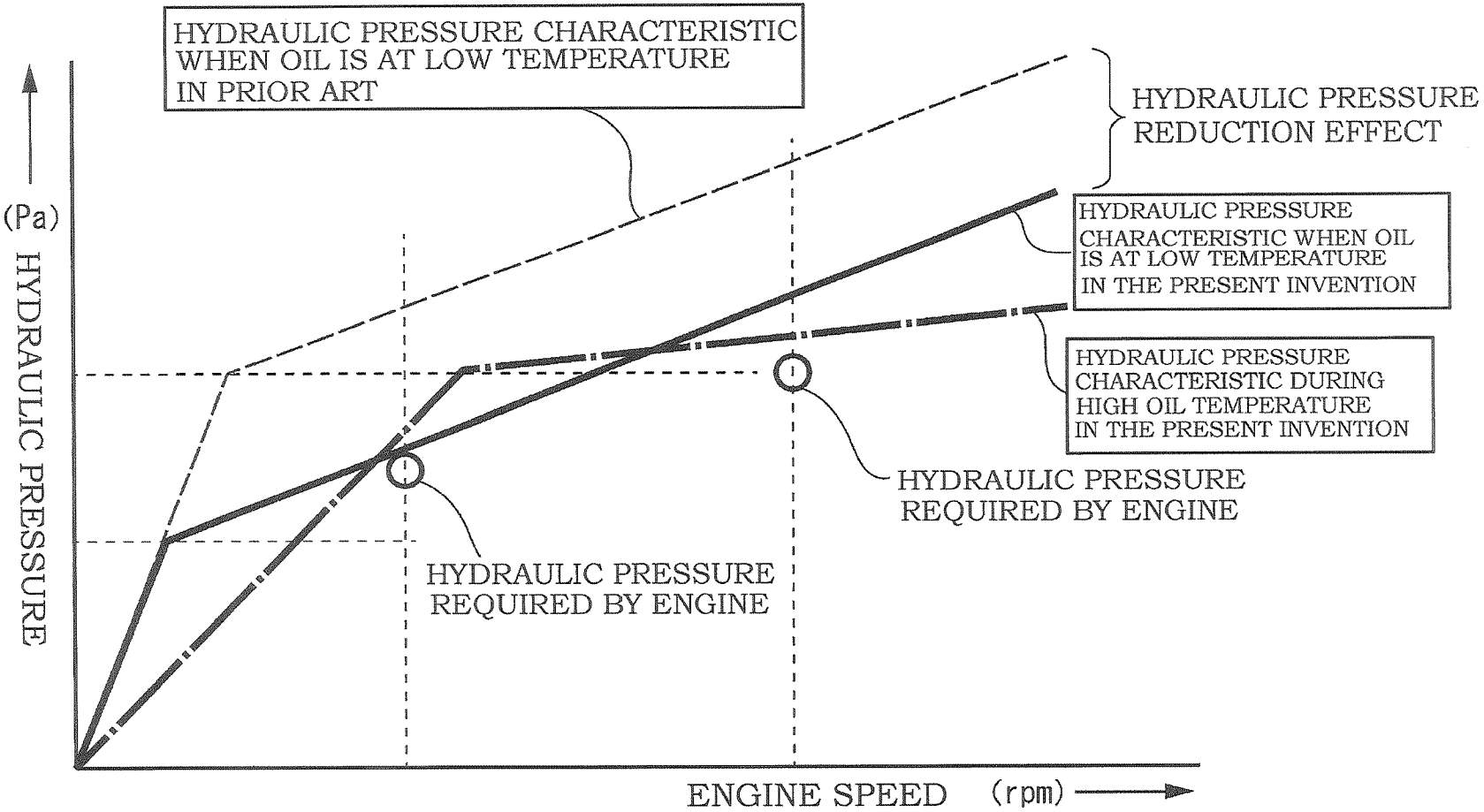
FIG. 8 is a graph showing characteristics of the present invention.

FIG. 8 indicates that, at both of the low oil temperature and the high oil temperature, the relief of the oil is properly performed and the discharge pressure from the oil pump 9 is suppressed not to reach a region where wasteful work is performed. In general, in the oil pump 9, the relief valve A, and the like, there are various kinds of required performance according to the performance of the engine 100. Among the kinds of required performance, there are various required discharge pressures of the oil at predetermined speed of the engine. This is referred to as required hydraulic pressure of the engine 100. In the present invention, it is possible to perform the relief operation on the basis of such a required hydraulic pressure.

A second embodiment of the present invention is explained with reference to FIGS. 5 to 7B. Like the first embodiment explained above, the second embodiment mainly includes the relief valve A, the temperature sensitive valve B, the main channel 61, the relief channel 62, the auxiliary channel 63, and the oil pump 9 (see FIG. 5). The configurations of the temperature sensitive valve B and the oil pump 9 in the second embodiment are substantially the same as the configurations in the first embodiment. The relief discharge section 35 of the relief valve A is provided on the large diameter valve chamber 32 side.

The configuration of an oil circuit including the relief valve A, the temperature sensitive valve B, and the oil pump 9 in the second embodiment of the present invention is explained. In the second embodiment, as in the first embodiment, the relief channel 62 and the auxiliary channel 63 are present. First, the relief channel 62 branching from the branch channel 61*a* of the main channel 61 communicates with the second inlet section 34 of the large diameter valve chamber 32 of the relief valve A.

In the oil circuit, the auxiliary channel 63 branching from the branch channel 61*a* of the main channel 61 is provided. The auxiliary channel 63 includes the first auxiliary channel 63*a* and the second auxiliary channel 63*b*. As in the first embodiment, the first auxiliary channel 63*a* and the second auxiliary channel 63*b* are controlled to communicate or not to communicate with each other by the temperature sensitive valve B. The first auxiliary channel 63*a* communicates with the oil pump 9 and the first auxiliary port section 51 of the temperature sensitive valve B. The second auxiliary channel 63*b* communicates with the second auxiliary port section 52 of the temperature sensitive valve B and the first inlet section 33 of the relief valve A. The relief discharge channel 64 is provided between the relief discharge section 35 of the relief valve A and the oil pan 101.

A relief operation in a circulation circuit in the second embodiment of the present invention is explained. In the present invention, as it is evident from the configuration explained above, in the oil circuit, the engine 100, the relief valve A, the temperature sensitive valve B, and the like are disposed on the downstream side of the oil pump 9 (see FIG. 5). The oil discharged from the oil pump 9 flows to the relief channel 62 branching from the main channel 61. The oil is fed from the second inlet section 34 of the relief valve A into the large diameter valve chamber 32. The hydraulic pressure is always applied to the second pressure receiving surface 12*a* of the large diameter section 12 of the valve body 1.

The oil also flows to the first auxiliary channel 63*a* of the auxiliary channel 63 branching from the relief channel 62. The oil reaches the first auxiliary port section 51 of the temperature sensitive valve B. The temperature sensitive valve B detects the level of oil temperature and controls the first auxiliary channel 63*a* and the second auxiliary channel 63*b* to communicate or not to communicate with each other. When the first auxiliary channel 63*a* and the second auxiliary channel 63*b* are controlled to communicate with each other, the oil reaches the first inlet section 33 of the relief valve A and can apply the hydraulic pressure to the first pressure receiving surface 11*a* of the small diameter section 11.

Figure 6A:
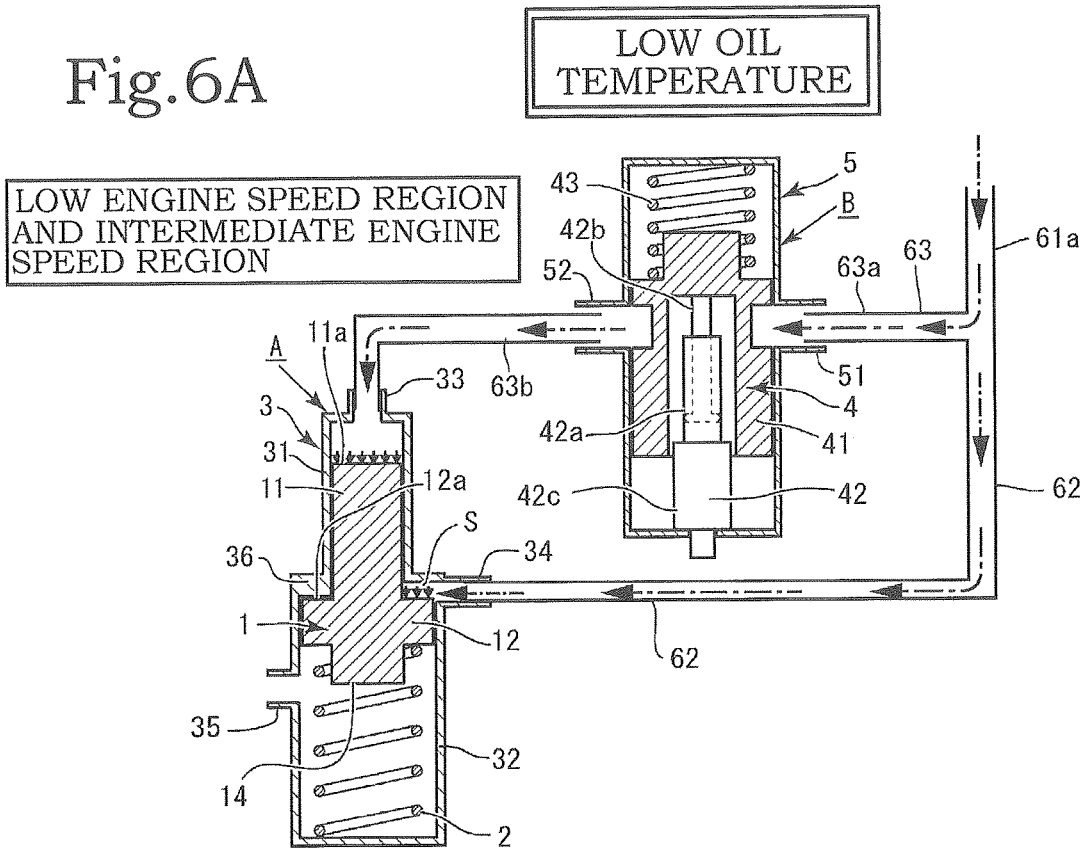
FIG. 6A is an enlarged schematic diagram showing the operations of a relief valve and a temperature sensitive valve at low oil temperature and in a low engine speed region and an intermediate engine speed region of an engine in the second embodiment of the present invention.
Figure 6B:
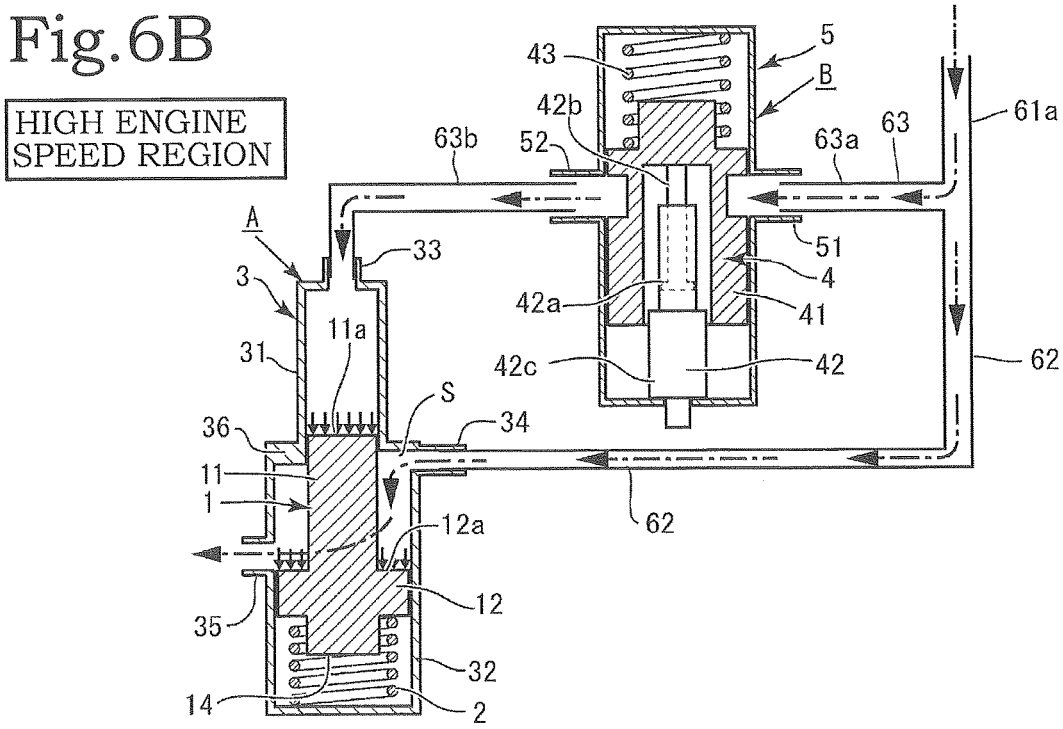
FIG. 6B is an enlarged schematic diagram showing the operations of the relief valve and the temperature sensitive valve at the low oil temperature and a high engine speed region of the engine.

An operation performed when oil temperature is low is explained with reference to FIGS. 6A and 6B. When the oil temperature is low, in the temperature sensitive valve B, the temperature sensitive sensor 42*c* of the temperature sensitive driving section 42 determines that the temperature of the oil is low and slides the temperature sensitive valve section 41 to a position where the first auxiliary port section 51 and the second auxiliary port section 52 communicate with each other (see FIG. 6A). The first auxiliary channel 63*a* and the second auxiliary channel 63*b* communicate with each other. The oil flows through both the channels. The oil is fed into the small diameter valve chamber 31 from the first inlet section 33. The oil applies the hydraulic pressure to the first pressure receiving surface 11*a* of the small diameter section 11.

Consequently, the hydraulic pressure is applied to both of the first pressure receiving surface 11*a* and the second pressure receiving surface 12*a* of the valve body 1 by the relief channel 62, the first auxiliary channel 63*a*, and the second auxiliary channel 63*b* branching from the main channel 61. In the row engine speed region and the intermediate engine speed region, even if a force by the pressure of the oil is applied to both of the first pressure receiving surface 11*a* and the second pressure receiving surface 12*a*, since the force is smaller than the elastic force of the elastic member 2, the relief operation is not performed (see FIG. 6A).

In the high engine speed region, the force by the pressure of the oil applied to both of the first pressure receiving surface 11*a* and the second pressure receiving surface 12*a* is larger than the elastic force of the elastic member 2. The valve body 1 slides, the relief discharge section 35 is opened, and relief is performed (see FIG. 6B). In this way, in the case of the low oil temperature, the temperature sensitive valve B controls the auxiliary channel 63 to be in a communication state and feeds the oil to the first pressure receiving surface 11*a* of the small diameter section 11 of the valve body 1. Consequently, the relief operation is easily performed. The relief operation is performed in the high engine speed region. It is possible to reduce wasteful work performed at hydraulic pressure higher than necessary hydraulic pressure. As a result, it is possible to improve fuel efficiency.

Figure 7A:
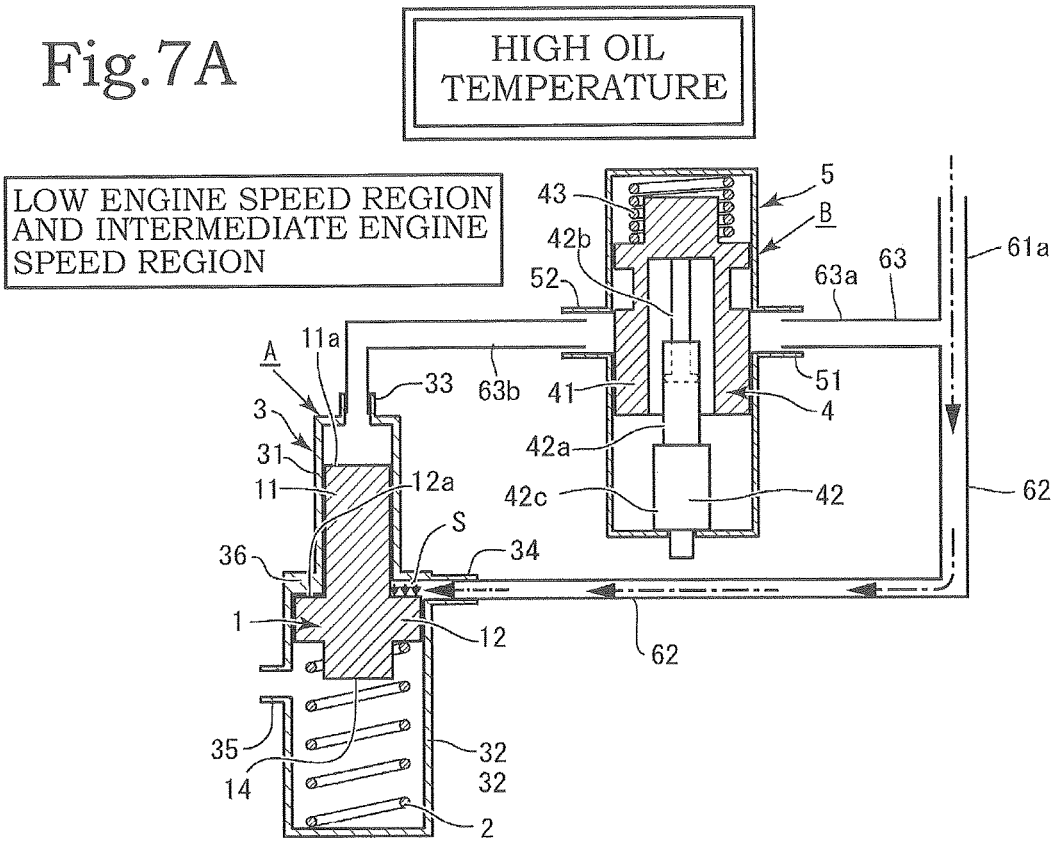
FIG. 7A is an enlarged schematic diagram showing the operations of the relief valve and the temperature sensitive valve at high oil temperature and in the low engine speed region and the intermediate engine speed region of the engine in the second embodiment of the present invention.

An operation performed when the oil temperature is high is explained with reference to FIGS. 7A and 7B. When the oil temperature is high, the temperature sensitive sensor 42*c* of the temperature sensitive driving section 42 determines that the temperature of the oil is high. The temperature sensitive valve B slides the temperature sensitive valve section 41 to a position where the first auxiliary port section 51 and the second auxiliary port section 52 do not communicate with each other (see FIG. 7A). Consequently, the first auxiliary channel 63*a* and the second auxiliary channel 63*b* do not communicate with each other. The hydraulic pressure is not applied to the first pressure receiving surface 11*a* of the small diameter section 11.

Therefore, the oil flows to only the relief channel 62. Only the second pressure receiving surface 12*a* of the large diameter section 12 of the valve body 1 receives pressure. At the high oil temperature and in the low engine speed region and the intermediate engine speed region, the valve body 1 of the relief valve A does not move, the relief discharge section 35 does not open, and relief is not performed.

Figure 7B:
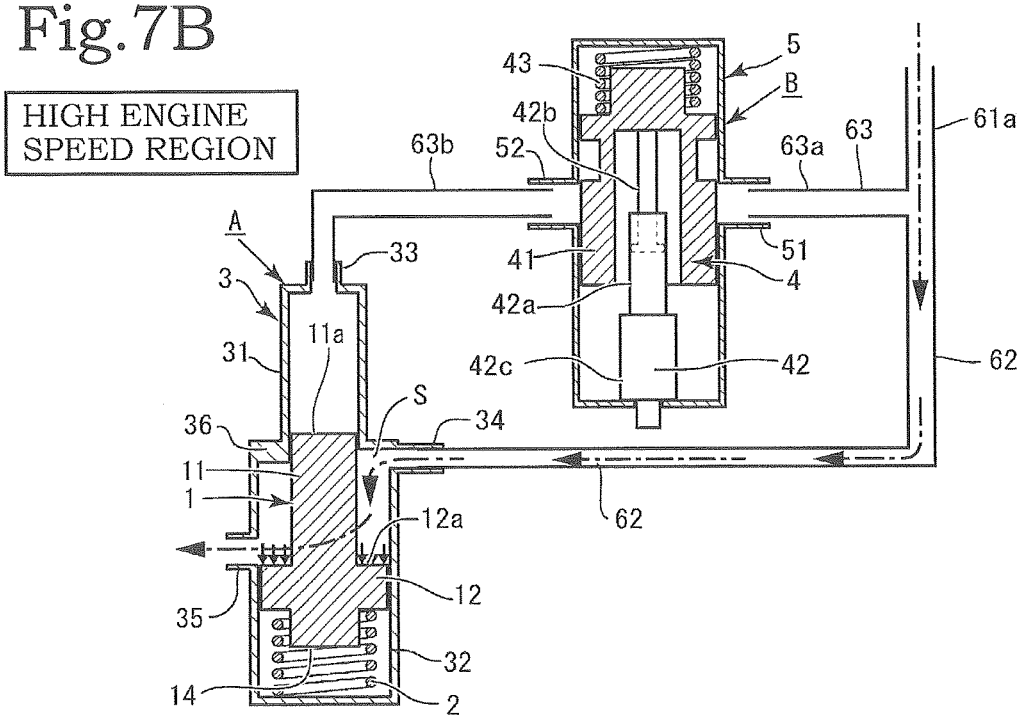
FIG. 7B is an enlarged schematic diagram showing the operations of the relief valve and the temperature sensitive valve at the high oil temperature and in the high engine speed region of the engine.

When the engine speed further increases and reaches the high engine speed region, even if the hydraulic pressure is applied to only the second pressure receiving surface 12*a* of the large diameter section 12 of the valve body 1, according to an increase in the force by the pressure received by the second pressure receiving surface 12*a*, the valve body 1 moves, the relief discharge section 35 opens, and the relief valve A performs a normal relief operation (see FIG. 7B).

In the second embodiment of the present invention, as in the first embodiment, the relief of the oil is properly performed and the discharge pressure from the oil pump 9 is suppressed not to reach a region where wasteful work is performed.

In the second embodiment, the relief discharge section is provided in the small diameter valve chamber. The relief channel causes the small diameter valve chamber and the oil pump to always communicate with each other. The auxiliary channel causes the large diameter valve chamber and the oil pump to communicate with each other. The other components are equivalent to the components in the first embodiment. Therefore, effects equivalent to the effects in the first embodiment are attained.

In a third embodiment, the relief discharge section is provided in the large diameter valve chamber. The relief channel causes the large diameter valve chamber and the oil pump to always communicate with each other. The auxiliary channel causes the small diameter valve chamber and the oil pump to communicate with each other. The other components are equivalent to the components in the first embodiment. Therefore, effects equivalent to the effects in the first embodiment are attained.

In a fourth embodiment, the projecting section that forms the gap is provided on at least any one side of the upper end part of the large diameter valve chamber and the top of the large diameter section. Therefore, even in the initial position state in which the pressure of the oil is not applied to the large diameter section of the valve body, the gap is formed between the top of the large diameter section (the second pressure receiving surface) and the top of the large diameter valve chamber in the valve body.

Therefore, when the oil flows into the large diameter valve chamber from the auxiliary channel, the oil instantaneously spreads to the entire top (the second pressure receiving surface) of the large diameter section and can apply uniform pressure. Therefore, the valve body can smoothly and quickly move together with the oil flowing into the small diameter valve chamber from the relief channel and perform the relief operation. It is possible to extremely simplify the structure for applying the pressure of the oil to the top of the large diameter section (the second pressure receiving surface) of the valve body.

In a fifth embodiment, the temperature sensitive valve includes the temperature sensitive valve body and the temperature sensitive housing. The temperature sensitive valve body includes the temperature sensitive valve section and the temperature sensitive driving section that includes the temperature sensitive sensor. The temperature sensitive valve section is slid in the temperature sensitive housing by the temperature sensitive driving section to thereby control the auxiliary channel to be in a communication state or in a non-communication state. Consequently, since the auxiliary channel is controlled to be in a communication state or in a non-communication state, it is possible to detect the temperature of the oil with a simplest configuration and cause the auxiliary channel to be in a communication state or in a non-communication state.

In a sixth embodiment, in the temperature sensitive sensor, the non-electronic control component is used. Therefore, since an electronically controlled component is not used, the temperature sensitive sensor is not affected by a deficiency of an electric system and can stably operate.

In a seventh embodiment, the thereto-wax is used as the temperature sensitive sensor. The thermo-wax is inexpensive. The temperature sensitive valve body operates according to expansion and contraction of the thermo-wax. Therefore, the temperature sensitive sensor can more smoothly operate.

What is claimed is:

1. A lubricant delivery system, comprising:

an oil pump receiving unpressurized oil through a suction port and providing pressurized oil through a discharge port;

a main channel for interconnecting the oil pump discharge port to a lubrication input port of an engine to provide pressurized oil to the engine;

an oil pan for storing unpressurized oil to be available to the oil pump via the suction port;

a pressure relief valve comprising:

a pressure relief valve housing;

a pressure relief valve body slidably mounted inside the pressure relief valve housing; and a pressure relief valve elastic member providing a predetermined tension opposing a sliding movement of the pressure relief valve body in the pressure relief valve housing, wherein the pressure relief valve housing has a first inlet for admitting pressurized oil and a second inlet for admitting pressurized oil, the elastic member opposing the sliding movement of the valve body due to an admission of pressurized oil through the first inlet and the second inlet, the pressure relief valve housing further having a relief discharge outlet that provides a bypass of pressurized oil to return to the oil pan when the admitted pressurized oil overcomes the predetermined tension of the elastic member; and a temperature sensitive valve comprising:

a temperature sensitive valve housing having an inlet for admitting pressurized oil received from the main channel and an outlet for providing pressurized oil to one of the first inlet of the relief valve housing and the second inlet of the relief valve housing;

a temperature sensitive valve body slidably mounted inside the temperature sensitive valve housing, a position of the temperature sensitive valve body in the temperature sensitive valve housing determining whether pressurized oil is provided to the temperature sensitive valve outlet;

a temperature sensitive valve elastic member providing a predetermined tension on the temperature sensitive valve body that determines a position of the temperature sensitive valve body in the temperature sensitive valve housing based on a temperature of the pressurized oil; and a temperature sensitive sensor that senses a temperature of the pressured oil, the temperature sensitive sensor providing a second tension on the temperature sensitive valve body that opposes the first tension of the elastic member such that pressurized oil is provided to the temperature sensitive valve outlet only when a temperature of the oil is below a predetermined temperature set by the temperature sensitive sensor, wherein one of the first inlet and the second inlet of the relief valve housing receives pressurized oil from the main channel so as to continuously provide pressurized oil to the pressure relief valve body with a first force opposing the predetermined tension of the pressure relief valve elastic member, and the other of the first inlet and the second inlet is connected to the temperature sensitive valve so that the pressure relief valve body receives an additional effect of pressurized oil opposing the predetermined tension of the pressure relief valve elastic member only when the oil temperature is below the predetermined temperature set by the temperature sensitive sensor, wherein the relief valve housing is shaped to include a small diameter section and a large diameter section, wherein the relief valve body is correspondingly shaped to include a small diameter section and a large diameter section such that the relief valve body can slide longitudinally in the relief valve housing, wherein the first inlet of relief valve housing admits pressurized oil to a large diameter chamber in the large diameter section of the relief valve housing, and the first inlet is connected to the main channel to continuously provide pressurized oil from the output of the oil pump to the large diameter chamber, and wherein the second inlet of relief valve housing admits pressurized oil to a small diameter chamber in the small diameter section of the relief valve housing, and the second inlet is connected to an output of the temperature sensitive valve to provide pressurized oil from the output of the oil pump to the small diameter chamber only when the oil temperature is below the predetermined temperature, thereby the pressurized oil in the small diameter chamber augments an effect of the pressurized oil in the large diameter chamber only when the oil temperature is below the predetermined temperature.

2. The lubricant delivery system according to claim 1, wherein a non-electronically controlled component is used in the temperature sensitive sensor.

3. The lubricant delivery system according to claim 2, wherein a thermo-wax is used as the temperature sensitive sensor.

4. The lubricant delivery system according to claim 2, wherein a shaped memory alloy or bimetal is used as the temperature sensitive sensor.

* * * * *